US007363872B1

(12) United States Patent
Binger et al.

(10) Patent No.: US 7,363,872 B1
(45) Date of Patent: Apr. 29, 2008

(54) METHOD AND APPARATUS FOR USE IN ASSEMBLY OF HYDROFOIL SKEG

(75) Inventors: Gilbert Allen Binger, Vancouver, WA (US); Michael Shane Mongelli, Milwaukie, OR (US)

(73) Assignee: Gunderson, LLC, Portland, OR (US)

( * ) Notice: Subject to any disclaimer, the term of this patent is extended or adjusted under 35 U.S.C. 154(b) by 0 days.

(21) Appl. No.: 11/591,298

(22) Filed: Oct. 31, 2006

(51) Int. Cl.
*B63B 1/24* (2006.01)

(52) U.S. Cl. ..... 114/274

(58) Field of Classification Search ..... 114/274
See application file for complete search history.

(56) References Cited

U.S. PATENT DOCUMENTS 4,217,844 A 8/1980 Gruzling
4,569,302 A 2/1986 Gruzling
4,588,872 A * 5/1986 Bollinger et al. ..... 219/124.34
4,782,779 A 11/1988 Heyrman et al.
4,915,048 A 4/1990 Stanford

* cited by examiner

*Primary Examiner*—Stephen Avila
(74) *Attorney, Agent, or Firm*—Chernoff, Vilhauer, McClung & Stenzel, LLP

(57) ABSTRACT

A method for preparing and assembling parts of a skin for a curved structure, and apparatus for use in connection therewith. A gantry may be used to carry cutting torches and welder heads along predetermined paths to cut skin plates accurately into skin parts and to weld the skin parts together again after they have been fastened to internal frame elements.

19 Claims, 12 Drawing Sheets

METHOD AND APPARATUS FOR USE IN ASSEMBLY OF HYDROFOIL SKEG

BACKGROUND

The present disclosure relates to assembly of structures with smoothly curved surfaces, and relates particularly to construction of hydrofoil shapes such as those of skegs for oceangoing barges.

Oceangoing barges can be towed more economically when equipped with hydrofoil skegs such as those disclosed in Gruzling, U.S. Pat. Nos. 4,217,844 and 4,569,302, and in Heyrman, et al., U.S. Pat. No. 4,782,779, than when not equipped with such skegs.

In the past, hydrofoil skegs for barges were manufactured in a highly labor-intensive manner, with skin plates for the skegs being cut oversized from plate material of the required thickness, and then bent to the required curved shape for the location of the skin. Thereafter, the bent skin plate was burned into three parts, a nose part, a middle part, and a tail part, and the edges of each part were then scarfed by hand so that a V-groove weld could be used to rejoin the parts of the skin plate during final assembly. Each skin plate part was welded to several supporting web members to form a structural section of the skeg, and girders were welded to the web members of the middle section. Finally, the nose and tail sections were welded to the middle section, which required numerous passes of hand welding to create the V-groove welds rejoining the sections of the skin parts for each side of the skeg, another multiple pass V-groove weld along the nose of the skeg, and welds along the tail edge of the skeg, to completely interconnect the skin plates of the opposite sides of the skeg to each other.

Cutting torches could be guided mechanically to follow lines scribed or drawn on the surface of the skin plate. For example, the cutting torch could be guided by tracks fastened to the metal being cut, but the tracks often shifted as a result of the heat distortion encountered during the burning process, but after being scarfed by hand the skin parts frequently did not meet closely when the structural sections were assembled, and gaps that resulted between the edges of the plate pieces were too deep to permit the plate sections to be simply welded together.

What is needed, then are methods by which to cut and bevel a plate to form parts of a skin for a skeg or hydrofoil more accurately than has been previously possible, and to assemble a hydrofoil structure more precisely, more quickly, and with less labor than was previously required for construction of such a hydrofoil structure.

SUMMARY OF THE DISCLOSURE

As an answer to some of the needs mentioned above the present disclosure provides a method and apparatus for use in manufacture of structures having curved outer surfaces, such as hydrofoil structures for waterborne vessels, as defined by the claims appended hereto.

In one embodiment of a method disclosed herein a skin plate for a hydrofoil structure is bent to a required shape, and then, in a single cutting operation, the skin plate is separated into skin parts, and margins of each of the skin parts are formed with a predetermined configuration.

According to one embodiment of the method the margins of a skin part may be appropriately shaped to form the sides of a groove along which the skin parts can be welded together efficiently in connection with joining structural sections including the skin parts.

In one embodiment of the method structural sections of a hydrofoil structure include respective ones of the skin parts, and after the structural sections are initially fastened together, at least two elongate joints between adjacent ones of the skin parts are welded simultaneously to rejoin the skin parts to each other as incorporated parts of a hydrofoil structure.

In one embodiment of apparatus that may be used in accordance with the method disclosed, a gantry is equipped with at least one pair of cutting torches and is movable along a predetermined path to carry the cutting torches, in order to cut a workpiece along a predetermined cutting path and also simultaneously to form margins, each having a predetermined configuration, on the resulting separate parts of the workpiece.

In one embodiment of such apparatus the gantry is equipped with at least a pair of welders arranged to be carried along a workpiece by the gantry to form simultaneously at least two welded seams to join at least three separate elements of a structure to one another.

In one embodiment of the apparatus disclosed such welders are arranged to precede the gantry as it moves along a predetermined path to perform the simultaneous welding operations.

In one embodiment of the apparatus such cutting torches are carried on the gantry so as to precede the gantry as it moves along a predetermined path relative to a workpiece while cutting the workpiece into separate parts.

The foregoing and other features and advantages will be more readily understood upon consideration of the following detailed description taken in conjunction with the accompanying drawings.

DETAILED DESCRIPTION OF EMBODIMENTS

Figure 2:
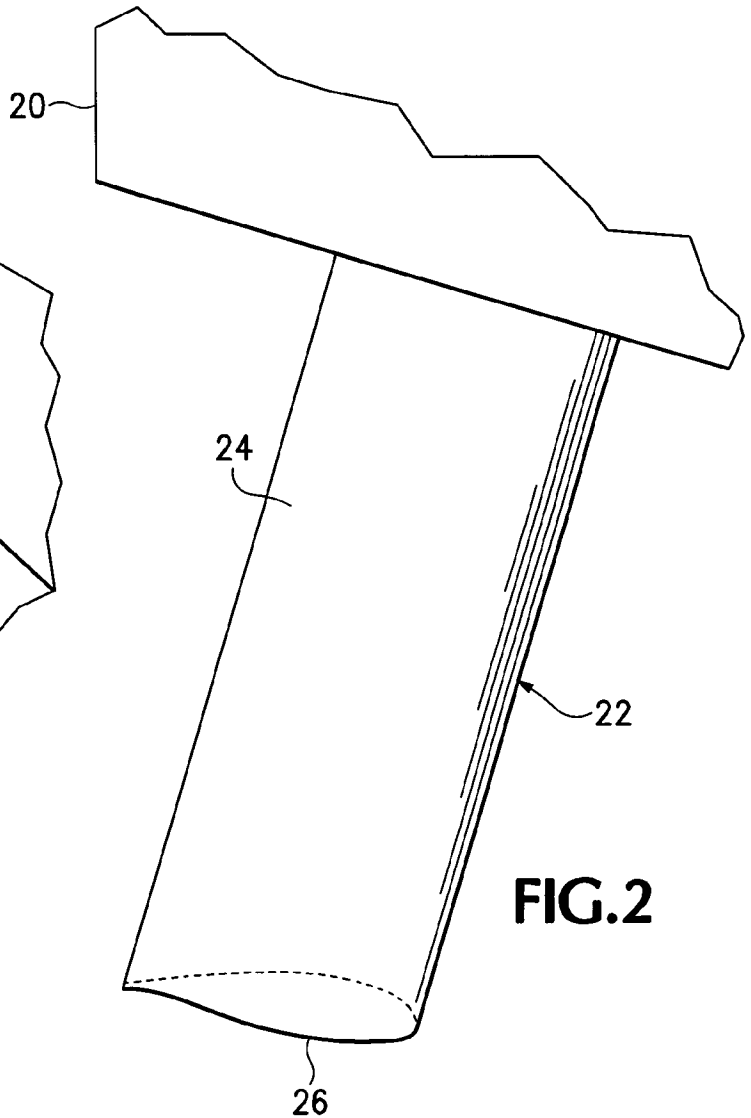
FIG. 2 is a side elevational view of a portion of the barge hull and the hydrofoil skeg arrangement shown in FIG. 1.
Figure 1:
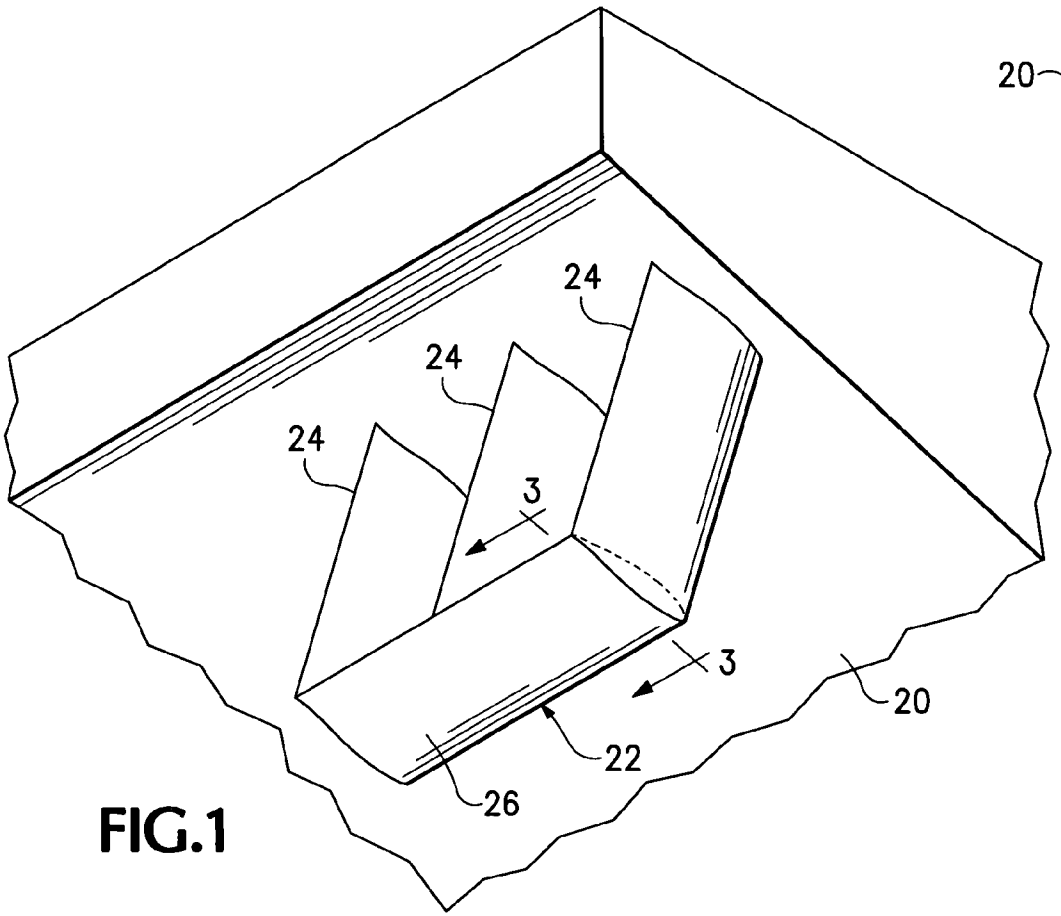
FIG. 1 is an isometric view from below and behind a starboard quarter of waterborne vessel such as a barge, showing a hydrofoil skeg arrangement mounted thereon.

Referring now to the drawings which form a part of the disclosure herein, in FIG. 1 a starboard quarter portion of an oceangoing barge hull 20 is equipped with a hydrofoil skeg arrangement 22 which may be generally similar to those disclosed, for example, in the previously mentioned Gruzling, U.S. Pat. Nos. 4,217,844 and 4,569,302. Such a skeg arrangement may include two or more vertical hydrofoil portions 24 extending downward from the hull 20 of the barge and interconnected at their lower ends by a horizontal hydrofoil portion 26. The vertical portions 24 and horizontal portion 26 of the skeg arrangement 22 are attached at selected angles relative to the hull 20 so that they affect the flow of water near the hull as the barge is towed, in order to reduce the energy required to tow the barge.

Figure 3:
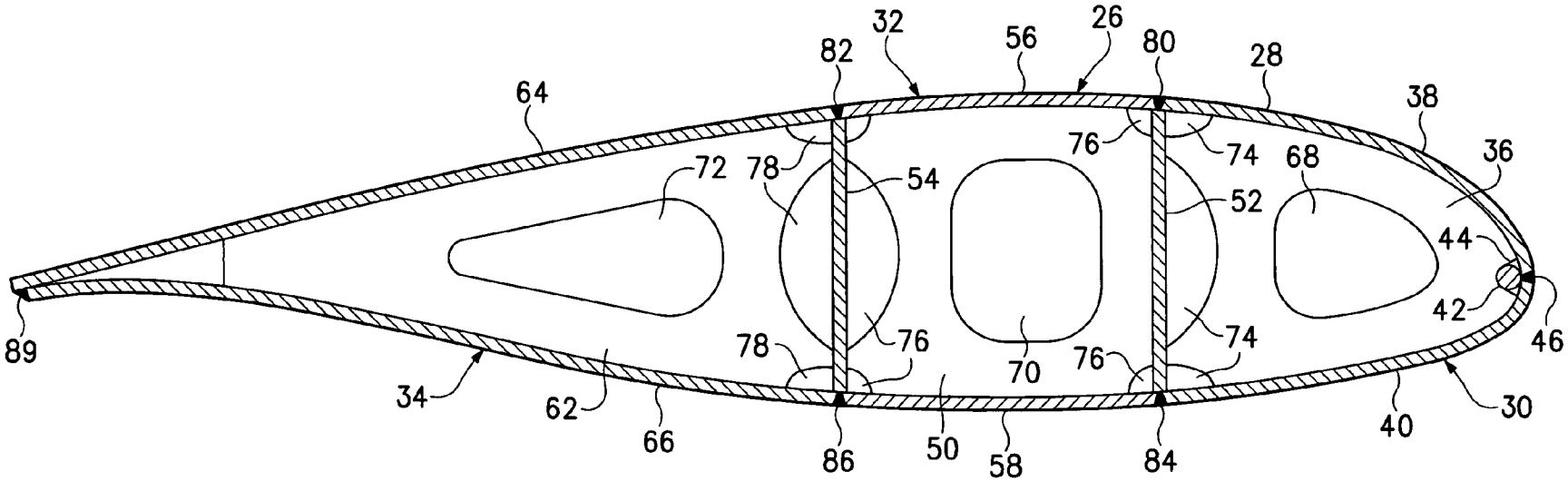
FIG. 3 is a sectional view, at an enlarged scale, of a generally horizontal hydrofoil skeg section, taken along the line 3-3 in FIG. 1.

The vertical and horizontal portions 24 and 26 of the skeg arrangement 22 are constructed generally similarly, with each vertical portion 24 and the horizontal portion 26 having generally similar hydrofoil shape defined by a respective skin 28 supported internally by a system of webs and girders. A horizontal portion 26 shown in section in FIG. 3 is representative of the general structures of any of the vertical portions 24 as well, with the exception of variations in the hydrofoil shape which do not affect the manner of construction and assembly of the skeg portion.

The horizontal skeg portion 26 includes a nose structural section 30, a middle structural section 32, and a tail structural section 34. The nose section 30 includes several apart-spaced nose webs 36, a top nose skin part 38, and a bottom nose skin part 40, all of material such as suitably thick steel plate. A backing bar 42 extends along the nose and is located in notches 44 defined in the nose webs 36. The webs 36 are welded to the top nose skin part 38 and bottom nose skin part 40, and the backing bar 42 is held in place in alignment with a nose seam 46 along which respective margins of the top nose skin part 38 and bottom nose skin part 40 are aligned with each other and welded together.

The middle structural section 32 of the hydrofoil structure of the horizontal portion 26 of the skeg arrangement 22, similar to the nose section 30, includes a plurality of parallel webs 50 that may be spaced apart from each other and aligned with corresponding ones of the nose webs 36. Transverse girder members 52 and 54 may also be of steel plate and may be welded or otherwise suitably attached to the webs 50 adjacent the nose section 30 and the tail section 34. A top skin part 56 and bottom skin part 58 of the middle structural section 32 are also welded to the webs 50.

The tail section 34 similarly may include a plurality of webs 62 of steel or other metal which may be spaced apart from and parallel with one another and aligned with respective ones of the webs 50 of the middle section 32, and to which a top tail skin part 64 and a bottom tail skin part 66 may be welded.

The webs 36, 50, and 62 may define respective central openings 68, 70, and 72 to reduce their weight, and may define cutouts 74, 76, and 78 along the girders 52 and 54 and near the intersections of the skin parts 38, 40, 56, 58, 64, and 66 with the girders 52 and 54.

The three skin parts 38, 56, and 64 of the top portion of the skin 28 of the horizontal hydrofoil structure portion 26 are interconnected with each other and with the girders 52 and 54 along welded seams 80 and 82. Similarly, the three skin parts 40, 58, and 66 of the portion of the skin 28 on the opposite, or bottom side of the horizontal hydrofoil structure portion 26 are also interconnected with each other and with the girders 52 and 54 by welded seams 84 and 86. The nose section top skin part 38 is welded to the nose section bottom skin part 40 along the nose seam 46 at the nose of the hydrofoil structure 26, as previously mentioned. The top tail skin part 64 and bottom tail skin part 66 of the tail structural section 34 are welded together along the tail margin 89 of the horizontal hydrofoil structure 26.

The hydrofoil structures of the skeg vertical portions 24 or horizontal portions 26 of skeg arrangements 22 may be constructed by assembling sets of nose webs 36, middle section webs 50, and tail section webs 62, all cut from suitable material such as ½ inch thick steel plate, with skins 28 and girders 52 and 54 that may be of steel plate or other suitable metal of a greater thickness, such as ¾ inch. The skins 28 may be manufactured by first cutting a skin blank plate 90 of suitable plate material to an appropriate size, leaving a margin strip beyond the desired final size of the actual skin portion, for use such as in handling the plate 90. The skin plate 90 may then be bent to the appropriate shape in which it will be used as the skin of a hydrofoil structure, which may be a shape which is uniformly curved along the entire length 92 of the plate 90. Separation lines 94, 96, and 98 may be etched, chalked, or otherwise defined along a surface of the plate 90 to indicate the proper locations for cuts to divide the plate 90 into separate portions such as the nose skin part 40, middle skin part 58, and tail skin part 66 of the bottom skin of the hydrofoil structure 26, and to separate a margin portion 100 from the nose skin part 40 in preparation for assembly of the nose, middle, and tail structural sections 30, 32, and 34 of the hydrofoil structure 26.

Figure 4:
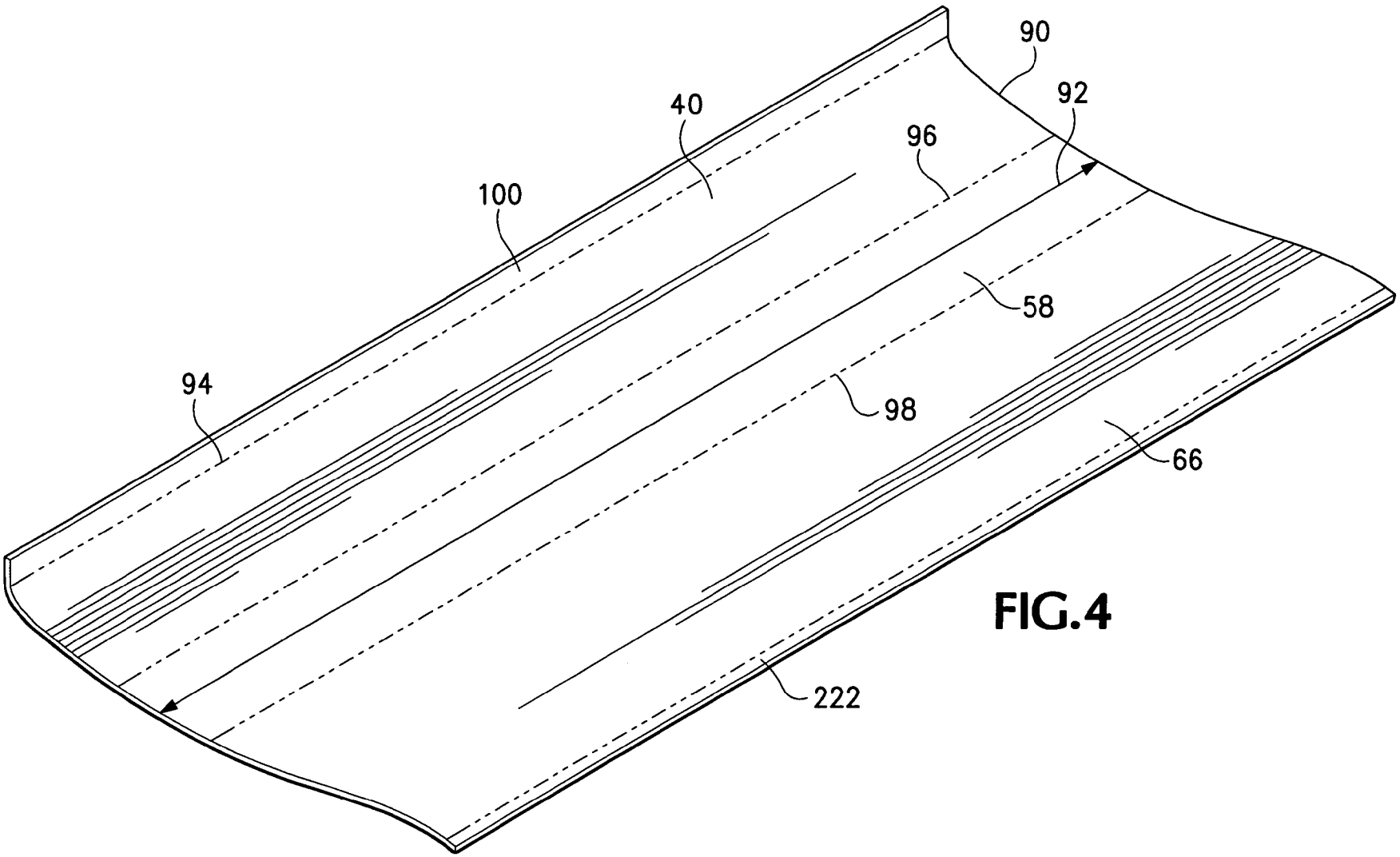
FIG. 4 is an isometric view of an upper, or inner, side of a bottom skin plate for a hydrofoil structure such as that shown in sectional view in FIG. 3.
Figure 5:
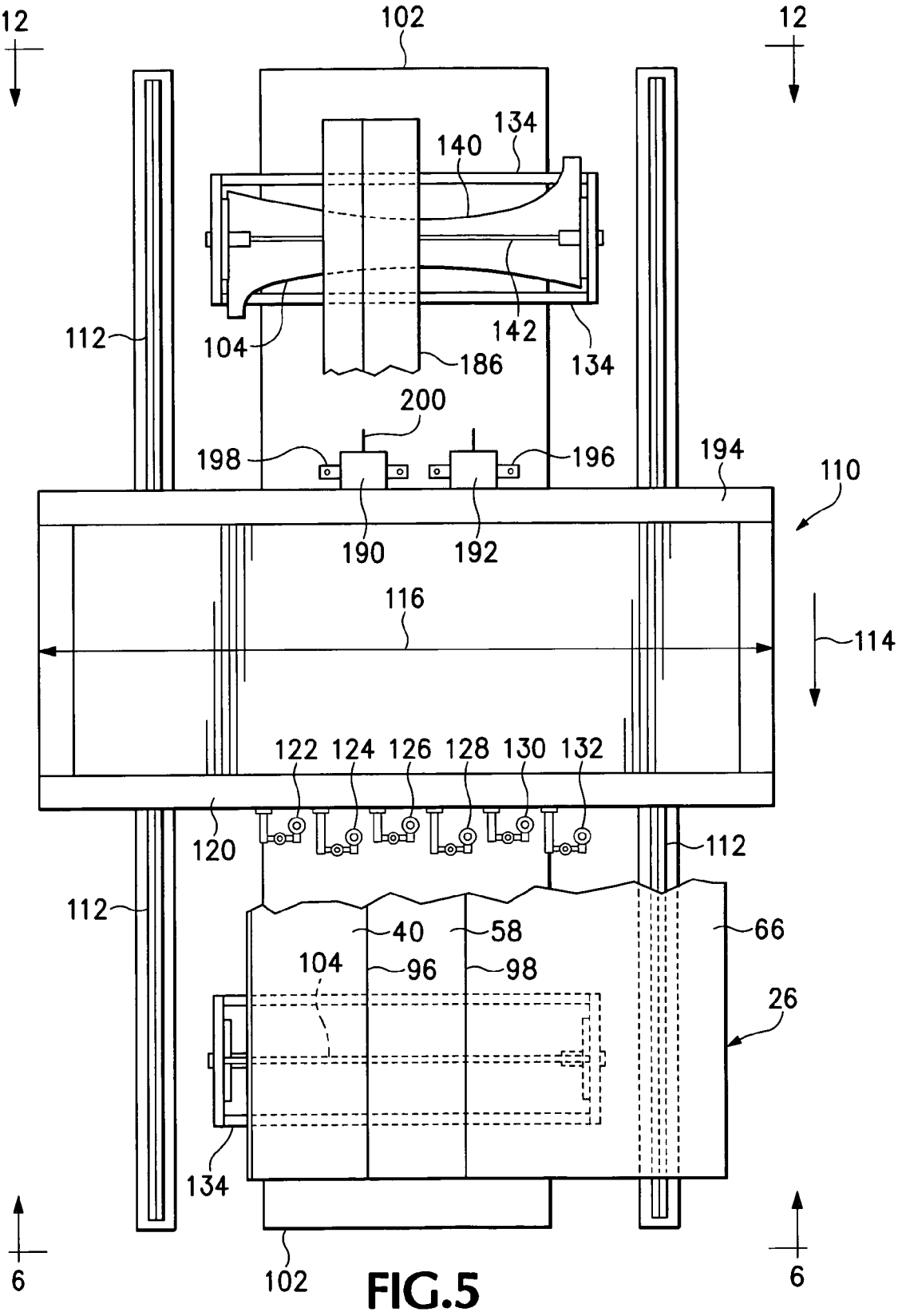
FIG. 5 is a top plan view of a parts support table and an associated gantry carrying an arrangement of cutting torches and welders.
Figure 6:
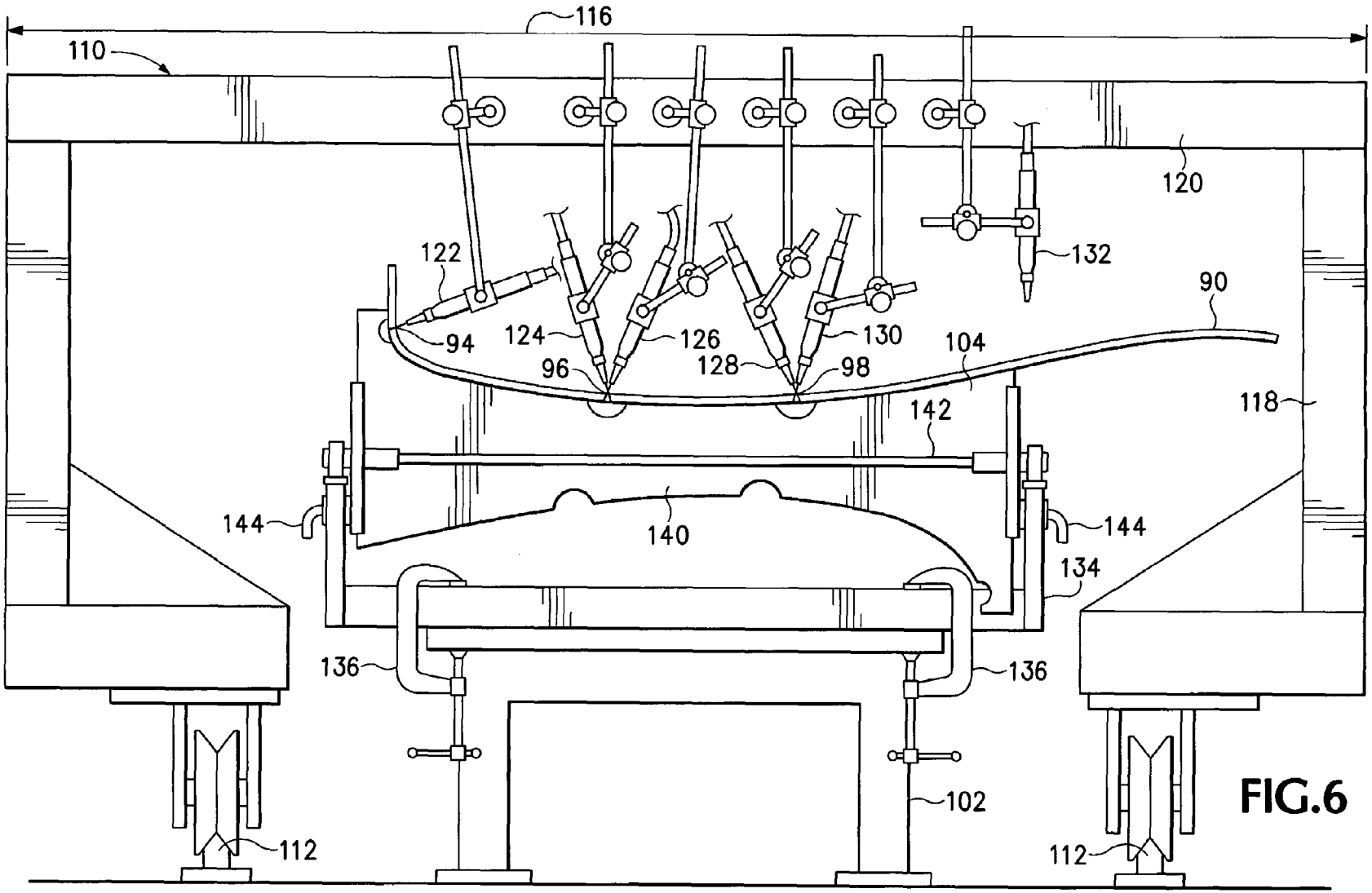
FIG. 6 is an end elevational view of the parts support table and gantry shown in FIG. 5, taken along line 6-6 of FIG. 5 and showing a skin plate such as the one shown in FIG. 4 being cut into separate parts.

As shown in FIGS. 5 and 6, the plate 90 may be cut along the lines 94, 96, and 98 in a single cutting operation to form the bottom skin parts 40, 58, and 66 and to provide simultaneously a desired configuration of each of the edge surfaces or margins of the bottom skin parts 40, 58, and 66 along which to form the welded seams 46, 84, and 86, as will be explained in greater detail presently. This operation of cutting along the lines 94, 96, and 98 may be accomplished according to the method disclosed herein so as to provide uniformly parallel and straight cuts along the separation lines 94, 96, and 98, by supporting the bent skin plate 90 on a table 102 equipped with a set of cradle forms 104 built to conform to the shape of the skin plate 90 when it has been bent to the required shape as shown in FIG. 4. Several cradle forms 104, for example five cradle forms 104 for a plate 90 having a length 92 of about 22 feet, are used to provide ample and solid support for the bent plate 90 atop the table 102.

The table 102 may be located beneath a predetermined path of a gantry 110, defined as by pair of parallel rails 112. The gantry 110 may include a motor (not shown) so as to be movable at an accurately controllable speed along the rails 112 in a forward direction indicated by the arrow 114 in FIG. 5, or in an opposite rearward direction. It will be understood that the gantry may be supported otherwise than on the rails 112, so long as it is moveable along an accurately defined path with respect to the location of the table 102 and a workpiece, such as the skin plate 90, supported on the table 102. The table 102 and the cradle forms 104 are set to support a bent skin plate 90 so that its entire length 92 is oriented generally horizontally and parallel with the rails 112 or otherwise defined path along which the gantry 110 is arranged to move.

Sufficient clearance is available beneath the gantry 110 to allow the gantry 110 to be moved along and over the skin plate 90 while it is supported on the table 102. Thus the gantry 110 has an amply large width 116 between side posts 118 to provide clearance in a transverse direction with respect to the forward direction indicated by the arrow 114 as the gantry moves along the rails 112.

Supported on a transverse member 120 extending along the front of the gantry are an array of adjustably supported cutting torches 122, 124, 126, 128, 130, and 132. The cradle forms 104 may be supported on individual stands 134 fastened adjustably to the top of the table 102, as by clamps 136 allowing for shims (not shown) to be held between the stands 134 and the top of table 102 as necessary to align the cradle forms 104 with each other and with the path of movement of the gantry 110, so that as the gantry 110 moves along the tracks 112 or other predetermined path of movement the individual cutting torches, once adjusted to a required position and orientation with respect to one of the separation lines 94, 96, and 98, will be carried along the respective separation line by the gantry 110 at a constant distance 138 from a plate 90 being cut, as shown in FIG. 7, along the entire length 92 of the plate 90 as the gantry 110 moves along the rails 112.

As shown best in FIG. 6, the stands 134 may be constructed so as to support a similar cradle form 140 on an opposite side of a pivot axis 142 defined by the stands 134, so that the cradle forms 104 or 140 can be selected by simply rotating them about the axis 142, and thereafter the selected cradle form 104 or 140 can be held in the required position by the use of devices such as latches 144, so that, when desired, the cradle forms 140 each can easily be placed in the required position to be used to support a bent skin plate (not shown) appropriately shaped to become a top skin portion for the hydrofoil structure 26.

In order to divide a bent plate such as the plate 90, the plate is placed to be supported by the appropriate cradle forms 104 or 140 mounted on the table 102, and the gantry 110 is positioned in the location corresponding to the top of FIG. 5. The cutting torches 122, 124, etc. are positioned to cut the plate along the separation lines 94, 96, and 98, with each cutting torch adjusted to burn a narrow kerf through the plate 90 so as to leave a margin surface on the resulting separate skin parts 40, 58, and 66 that is inclined at an angle 150 or 152, as for example at 20-40 degrees, from being normal to the plate 90 or the respective skin section 40, 58, or 66. This may be accomplished by arranging the flames of both the cutting torches 124 and 126 to be directed at the separation line 96 and arranging the flames both of the cutting torches 128 and 130 to be directed toward the separation line 98, on the upper, or interior, side of the plate 90 as it rests on the cradle forms 104. The cutting torch 126 may be located closer than the cutting torch 124 to the transverse member 120 of the gantry 110, and, similarly, the cutting torch 130 may be located closer to the transverse member 120 than is the cutting torch 128, so that the cutting torches 124 and 128 precede the torches 126 and 130 in cutting as the gantry 110 moves forward as indicated by the arrow 114. The cutting torches may, then, be oriented so that their cutting flames 146 and 148 are directed as shown in FIG. 7, at the angles 150 and 152 with respect to a plane perpendicular to the plate 90 and extending along the separation line 98. The cutting torch 122 is similarly oriented non-perpendicularly with respect to the plate 90 along the separation line 94, as shown in FIG. 6.

Figures 7, 8:
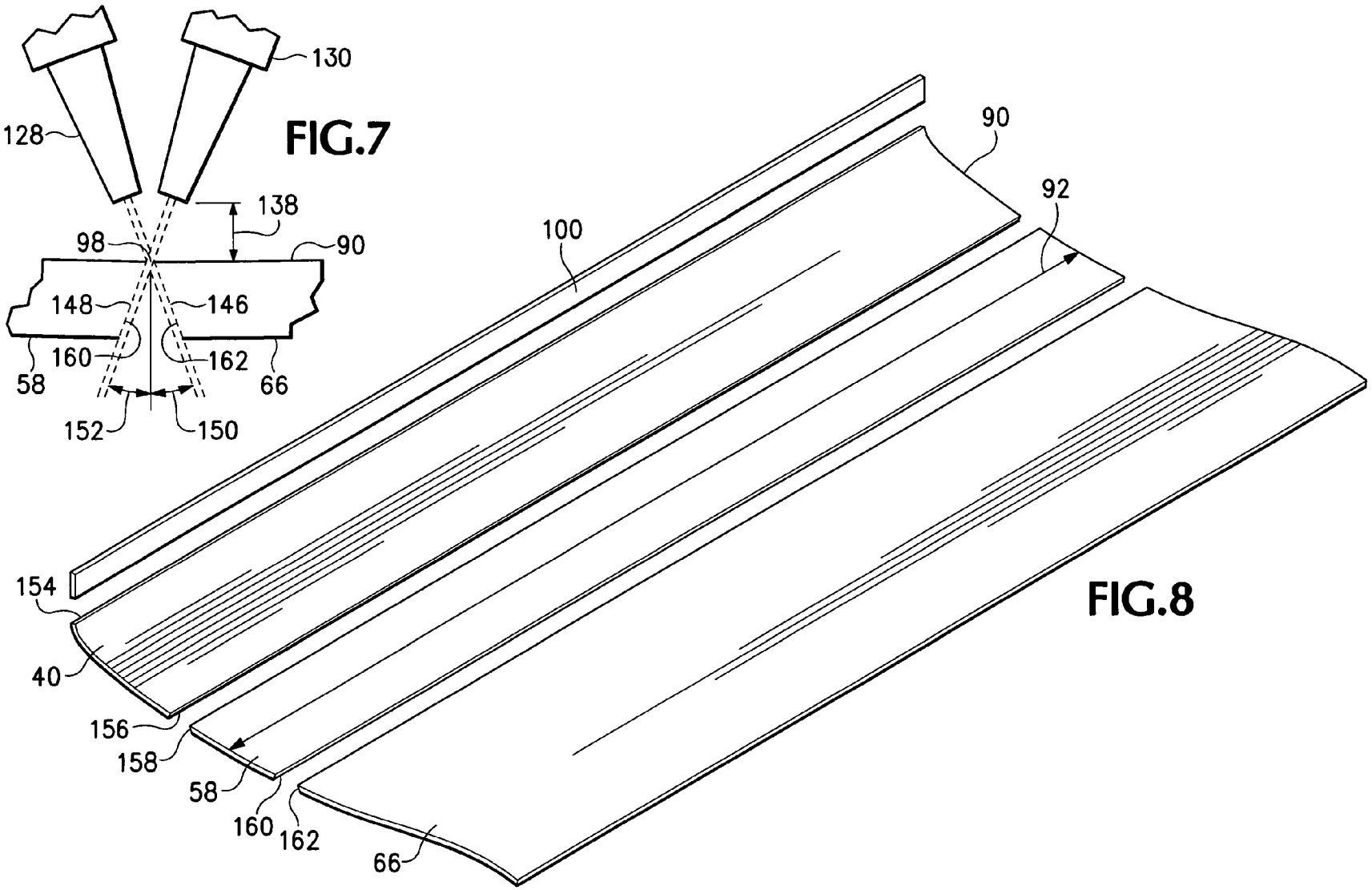
FIG. 7 is a detail view at an enlarged scale showing the arrangement of a pair of the cutting torches shown in FIG. 6.
FIG. 8 is a view similar to that of FIG. 4 showing the skin plate after it has been cut into separate parts.

With the cutting torches 122, 124, 126, 128, and 130 operating, the gantry 110 is then moved at a controlled speed, such as, for example, 8 inches per minute, along the entire length 92 of the plate 90, and the torches cut the plate into the separate elongate parts shown in FIG. 8, including the narrow margin piece 100, the nose section bottom skin part 40, the middle section bottom skin part 58, and the tail section bottom skin part 66. Because of the arrangement of the cutting torches, each of the margin surfaces 154 and 156 of the nose section bottom skin part 40, the margin surfaces 158 and 160 of the middle section skin part 58, and the adjacent margin surface 162 of the tail section bottom skin part 66 are all oriented at non-perpendicular slopes with respect to the major surfaces of the plate 90.

It will be appreciated that during this cutting operation, as the gantry 110 moves in the forward direction, indicated by the arrow 114, the cutting torches precede the gantry 110 and are thus clearly in view, so that they can be adjusted, as in the event that the plate 90 appears to have been misaligned, and so that it is generally easier to visually monitor the progress of the cutting operation.

When the skin plates 90 for both sides of a hydrofoil structure 26 have been bent and cut into the several skin parts as described above, assembly of the hydrofoil structure is performed by first assembling three separate structural sections, the nose structural section 30, the middle structural section 32, and the tail structural section 34. The structural sections 30, 32, and 34 are then fitted together to form the completed hydrofoil structure 26.

Figure 9:
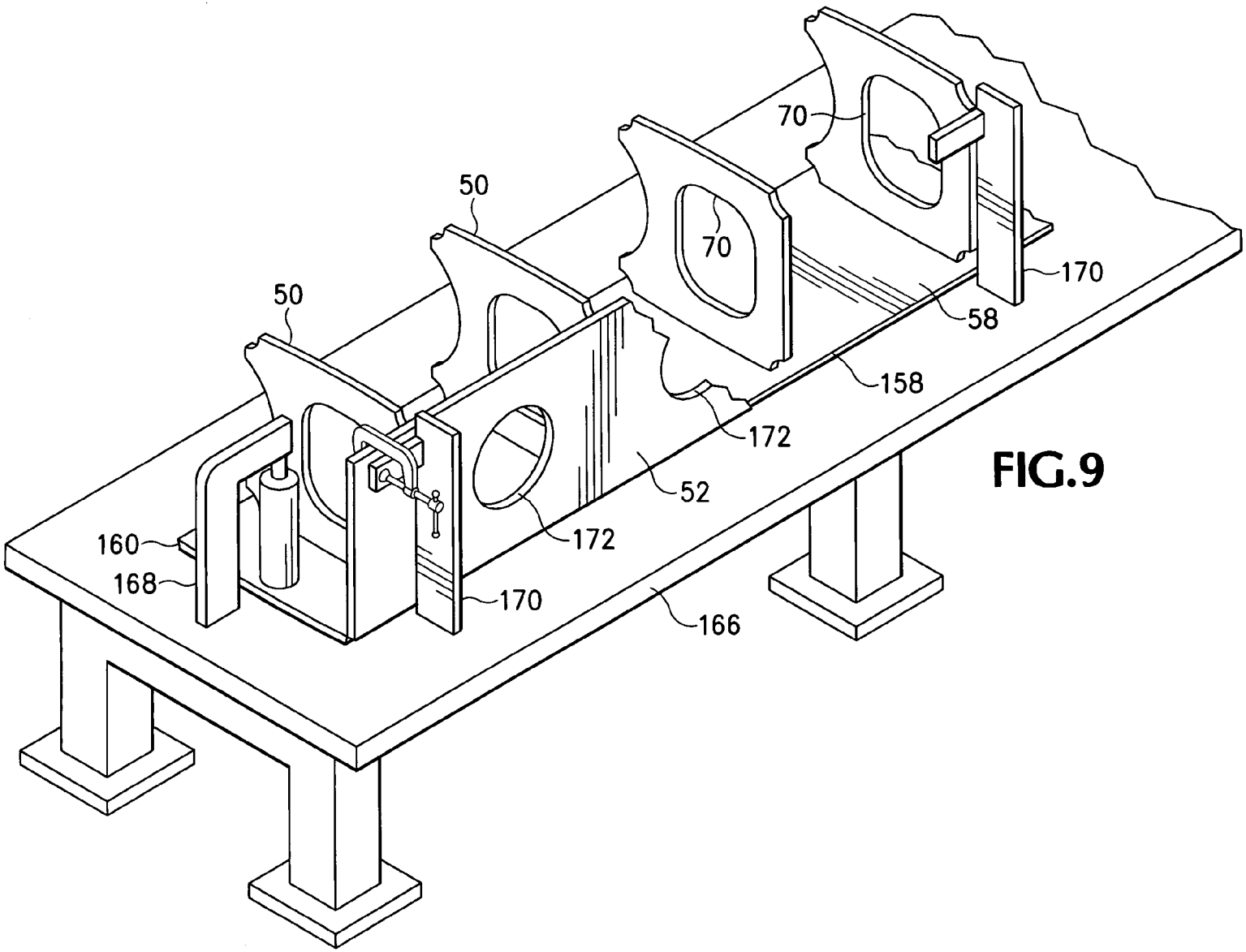
FIG. 9 is an isometric view showing web members being attached to a middle skin part and a girder member, as a step in assembling a middle structural section of a hydrofoil structure such as that shown in FIGS. 1-3.

To assemble the middle structural section 32 a skin part such as the bottom middle skin part 58 is placed on an assembly table 166 and clamped to the table top in a predetermined position, as by the use of a suitable hydraulic or mechanical clamp 168, as shown in FIG. 9. The table 166 may be provided with profiled pieces to support the curved shape of the skin section 58 accurately. Additional clamps (not shown) may be desirable to hold the skin part 58 in the desired position and keep it flat upon the top of the table 166, in order to overcome internal stresses within the middle section bottom skin part 58 which may have been released as a result of cutting the skin plate 90 into the several parts.

The table 166 may also be provided with several accurately located alignment stanchions 170 near which the skin part 58 may be placed and which are aligned perpendicular to the top of the table 166 to act as guides for alignment of the several webs 50 and the girder 52. The girder 52 is located as required along a margin of the skin part 58 and clamped to the stanchions 170, where it is held while it is securely tack welded to the middle bottom skin part 58. The webs 50 are then securely tack welded to the inner surface of the bottom middle skin part 58 and to the girder 52 in their predetermined locations, which may have been etched or scribed on the surface of the skin plate 90 before it was cut into the separate nose, middle, and tail skin parts. The girder 52 extends beyond the edge of the margin surface 158 to be used in interconnecting the middle structural section 32 with the nose structural section 30. Next, the girder plate member 54 may be securely tack welded to the opposite margin of the skin part 58 and to the webs 50, while the bottom middle skin part 58 remains clamped to the table 166. This forms a three sided box structure with the parallel webs 50 spaced apart along the structure.

Figure 10:
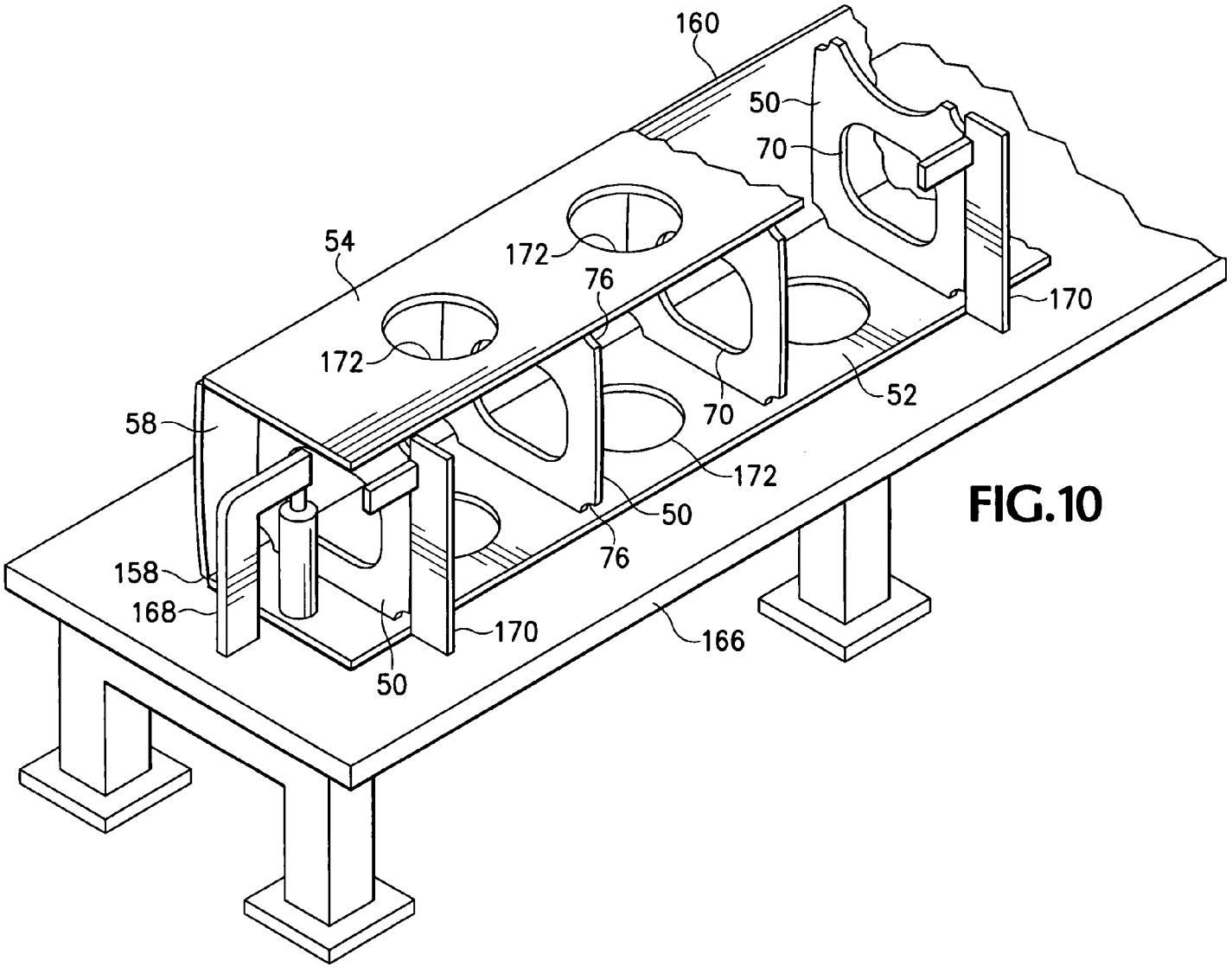
FIG. 10 is an isometric view showing a further step in the assembly of a middle structural section for a skeg including the web members and skin part shown in FIG. 9.

Next, as shown in FIG. 10, the bottom skin part 58 is released from the table top and the partially assembled middle structural section is then rolled 90 degrees and the webs 50 may be more completely welded to the girders 52 and d54 and to the bottom skin part 58 to structurally unite the webs 50, girders 52 and 54, and the skin sheet 58.

This completion welding may best be accomplished in a careful sequence to minimize the expansion and shrinkage effects of heating and cooling, and to provide a structure that is straight and free from unnecessary included stress upon completion of the welding. For example, welding can be begun along the web 50 nearest the middle of the length of the hydrofoil structure 26, first welding every second web 50 to the girder plate 52, in the angle on one side of each such web, then rolling the middle structural section 32 and welding along both sides of each of the same webs 50 to attach them to the girder plate 54, and thereafter also welding one side of the previously unwelded webs 50 to the girder 54. Next the middle structural section 32 can be rolled back 180 degrees and the remaining unwelded angles can be welded to connect the webs 50 completely to the first girder 52, after which the section can be again turned over and the remaining unwelded corners can be welded to completely fasten the remaining webs 50 to the girder plate 54.

Thereafter, the top middle skin part 56 can be placed into position and tacked securely into place, using a portable hydraulic press as necessary to hold the top skin part 56 in the required position with respect to the remainder of the middle structural section 32 until the skin part 56 is securely attached. The remainder of the welds necessary to securely interconnect the webs 50, girders 52 and 54, and skin parts 56 and 58 may then be completed by gaining access through the several holes 172 provided in each of the girders 52 and 54.

Figure 11A:
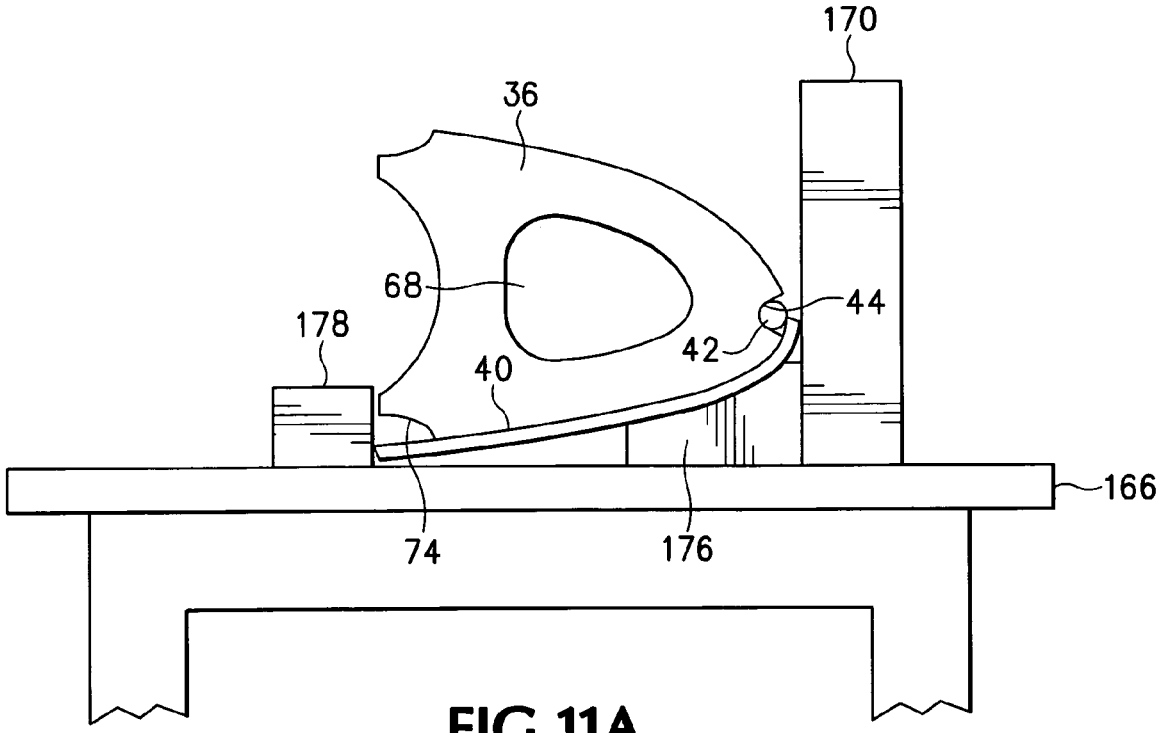
FIGS. 11A and 11B show steps in assembling skin members and web members of a nose structural section of the hydrofoil skeg structure shown in FIGS. 1-3.
Figure 11B:
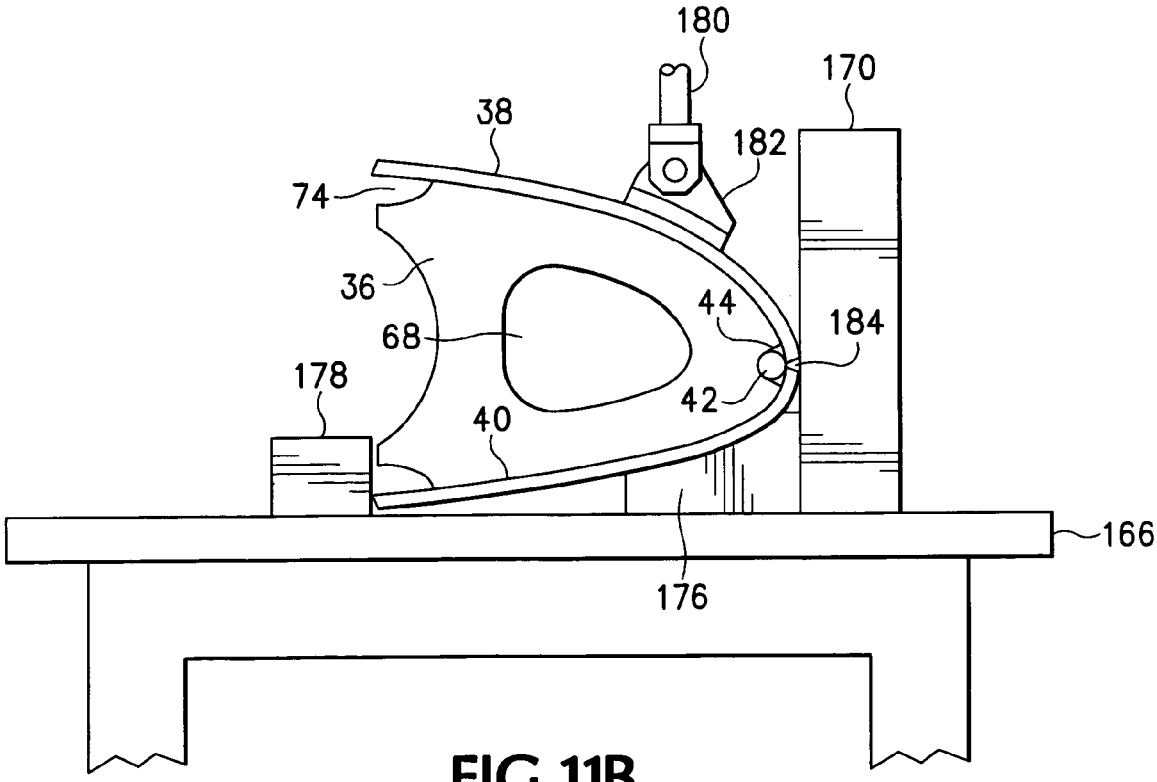

Assembly of the nose structural section 30 of the hydrofoil structure 26 is generally similar to the assembly of the middle section 32, although slightly simpler. As shown in FIGS. 11A and 11B, the nose section bottom skin part 40 may be fastened to the table 166, supported by cradle forms 176 shaped to correspond with the curvature of the outer surface of the nose structural section 30. Several of the forms 176 may be located on the table 166, spaced apart along the table at locations aligned with the alignment stanchions 170, for convenience. At predetermined locations along the nose bottom skin part 40, the nose webs 36 are placed on the bottom skin part 40 and aligned with the alignment bars 70 and then tack welded securely into position. Locator bodies 178 may be positioned on the top of the table 166 spaced apart and opposite the alignment stanchions 170, to help keep the bottom skin section 40 correctly aligned on the table 166. Portable overhead hydraulic rams may also be used to hold the bottom skin 40 properly aligned with the table 166 and the shaped forms 176 while the webs 36 are aligned with the skin section 40 and tack welded into place.

Once the nose webs 36 have been tacked to the bottom skin section 40, the nose backing bar 42 may be inserted through the notches 44, to fit snugly against the interior surface of the bottom skin section 40. When the backing bar 42 is properly located it may be fastened in place by being tack welded to at least the ones of the webs 36 at the ends of the nose section 30.

Thereafter, the top skin part 38 may be placed atop the nose webs 36, as shown in FIG. 11B. The top skin part 38 may be held in the required position, aligned with and fitting tightly against the webs 36, by devices such as an overhead hydraulic ram 180 equipped with a suitably contoured pressing head 182, while the top nose skin part 38 is tack welded to the nose webs 36. The pressing head 182 may include sharp hardened teeth to engage the top skin 38 securely while pressing it into the required position against the nose webs 36. It may been seen that the nose margin of the top skin part 38 is thereby positioned in contact with the backing bar 42, and that the inclined margin surfaces of the nose skin parts 38 and 40 define a V-shaped groove 184 seen in end view in FIG. 11B. Sacrificial spacers of material such as ¼ inch×¼ inch steel stock may be placed in the bottom of the groove and tack welded to the round bar 42 along the margin of the bottom skin sheet 40 to assure that the V-shaped groove 184 has a root width sufficient to assure good weld penetration for completion of the nose seam 46.

Once the top skin part 38 has been securely tack welded to the webs 36, the webs 36 may be welded completely to the skin parts 38 and 40, as by welding them in a sequence similar to that described above with respect to welding the middle section webs 50 into place between the girders 52 and 54, so as to complete assembly of the nose section 30 with a minimum of distortion resulting from thermal expansion and contraction of the welds.

With the inclined nose margin surfaces 154 of the top skin section 38 and bottom skin section 40 extending to the backing bar 42, the V-shaped groove 184 is fairly tightly closed at its bottom by the backing bar 42, and any gaps which do remain along the backing bar 42 may be closed simply by welding them shut by hand if necessary.

When welding of the nose skin parts 38 and 40 to the webs 36 has been completed the nose structural section 30 may be lifted from the assembly table 166 by a suitable crane and may be placed nose-up on the table 102 beneath the gantry 110 with the V-shaped groove 184 facing openly upward. The nose structural section 30 may be supported upon the stands 134 mounted on top of the table 102, with the stands 134 adjusted to provide a flat support for the nose section 30, as by placing a flat plate 186 atop the stands 134, extending between them along the length of the table 102, as shown in FIG. 12.

Figure 12:
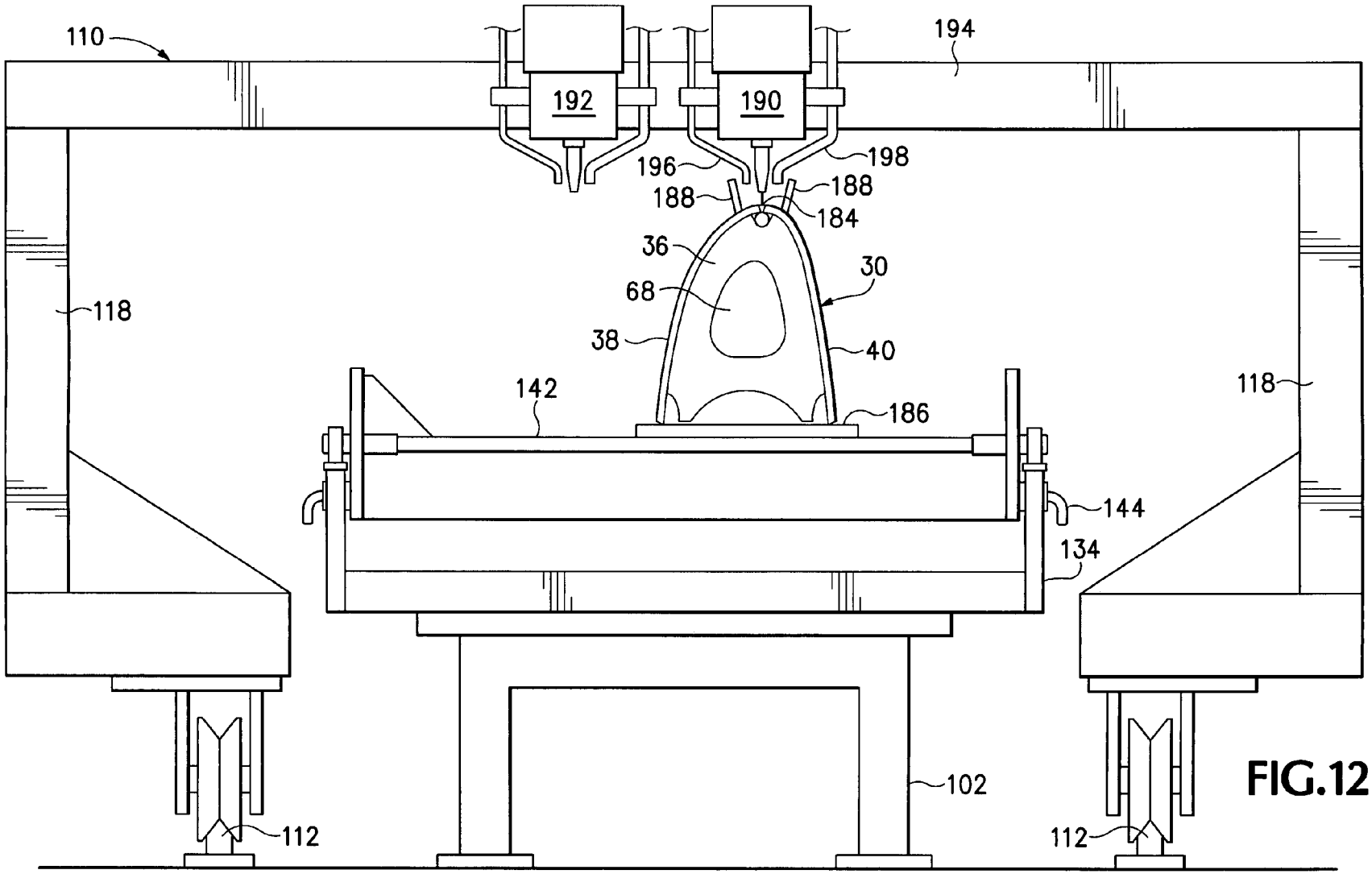
FIG. 12 is an end elevational view of the parts support table and gantry shown in FIG. 5, taken along line 12-12 of FIG. 5 and showing a nose seam being welded on the nose structural section shown in FIGS. 11A and 11B.

A pair of flux dams 188, which may be narrow strips of metal plate, may be tack welded to the nose skin parts 38 and 40 on either side of the V-groove 184 to form a trough along the groove 184 as shown in FIG. 12 to hold welding flux. A pair of submerged arc welders 190 and 192 are supported on a suitable transverse structural member 194 extending horizontally across the rear end 195 of the gantry 110, generally opposite the location of the transverse member 120 supporting the cutting torches 122, etc., as may be seen in FIG. 5. The nose section 30 is supported with the V-shaped groove 184 aligned parallel with the rails 112 supporting the gantry 110. Once the nose section is properly aligned the gantry may be moved in a rearward direction, opposite the direction of the arrow 114 shown in FIG. 5, to move the submerged arc welder 190 along the nose section 30 as it operates to weld together the nose margins of the top nose skin part 38 and the bottom nose skin part 40 of the nose structural section 30. With each of the skin parts 38 and 40 being of steel plate ¾ inch thick, for example, securely welding the seam 46 thus formed along the V-shaped groove 184 may take one to three welding passes along the nose structural section 30 to form a completely filled welded seam 46 that can be ground flush to provide a smooth surface along the nose structural section 30 when completed. Once the seam 46 is completely welded along the V-shaped groove 184 the flux dams 188 are removed.

Each of the submerged arc welders 190 and 192 may be equipped, for example to operate using two electrodes at conventional power settings for the material being welded, such as, a lead electrode operating with direct current at 33 volts, 600 amperes, and a trailing electrode operating with alternating current at 42 volts, and 740 amperes, with automatic wire feed electrodes and with the gantry operating at 18 inches per minute.

Each submerged arc welder 190 or 192 includes a flux feed tube 196, for providing a flow of granulated flux into the trough defined by the flux dams 188, ahead of the electrodes. A flux removal vacuum tube 198 is provided for removing remaining granulated flux from behind the point at which the welder is actually operating along the seam being welded. A gauge wire 200 may extend forward from each welder 190 and 192, at a known position with respect to the welding electrodes, in order to verify that the workpiece remains in alignment with the path of the gantry 110 and the welders 190 and 192 carried thereon along the entire length of a seam being welded, and so that adjustments may be made to the welders during the progress of the gantry 110 during the welding operation, if necessary.

Assembly of the top tail skin part 64 and bottom tail skin part 66 to the webs 62 of the tail structural section 34 is similar to assembly of the nose structural section 30, except that a seam may need to be welded by hand along the trailing edge margin 89.

Once assembly of the tail structural section 34 has been completed, the structural sections 30, 32, and 34 of the hydrofoil structure may be fastened to each other. According to one embodiment of the present method, the tail structural section 34 may be placed on an assembly table 204 in a horizontal position with its trailing edge seam 89 facing outboard and the open side of the tail structural section 34 facing toward the middle of the table.

Figure 13:
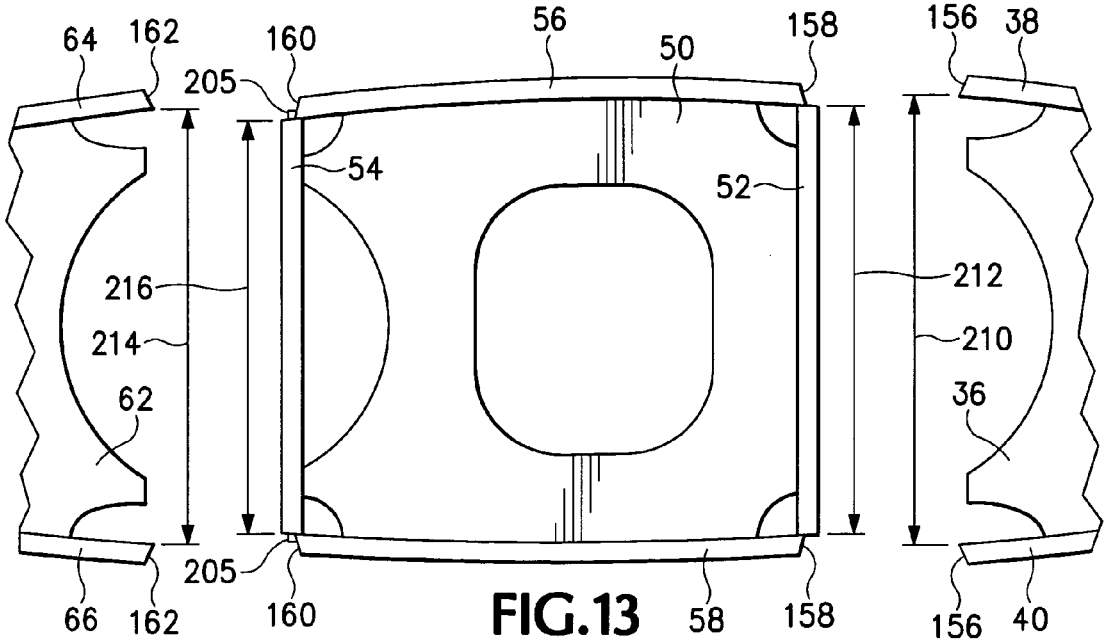
FIG. 13 is a sectional view of the middle structural section of a hydrofoil structure such as is shown in FIG. 3, at an enlarged scale, together with portions of the nose and tail structural sections, prior to their being fitted together with the middle section.
Figure 15:
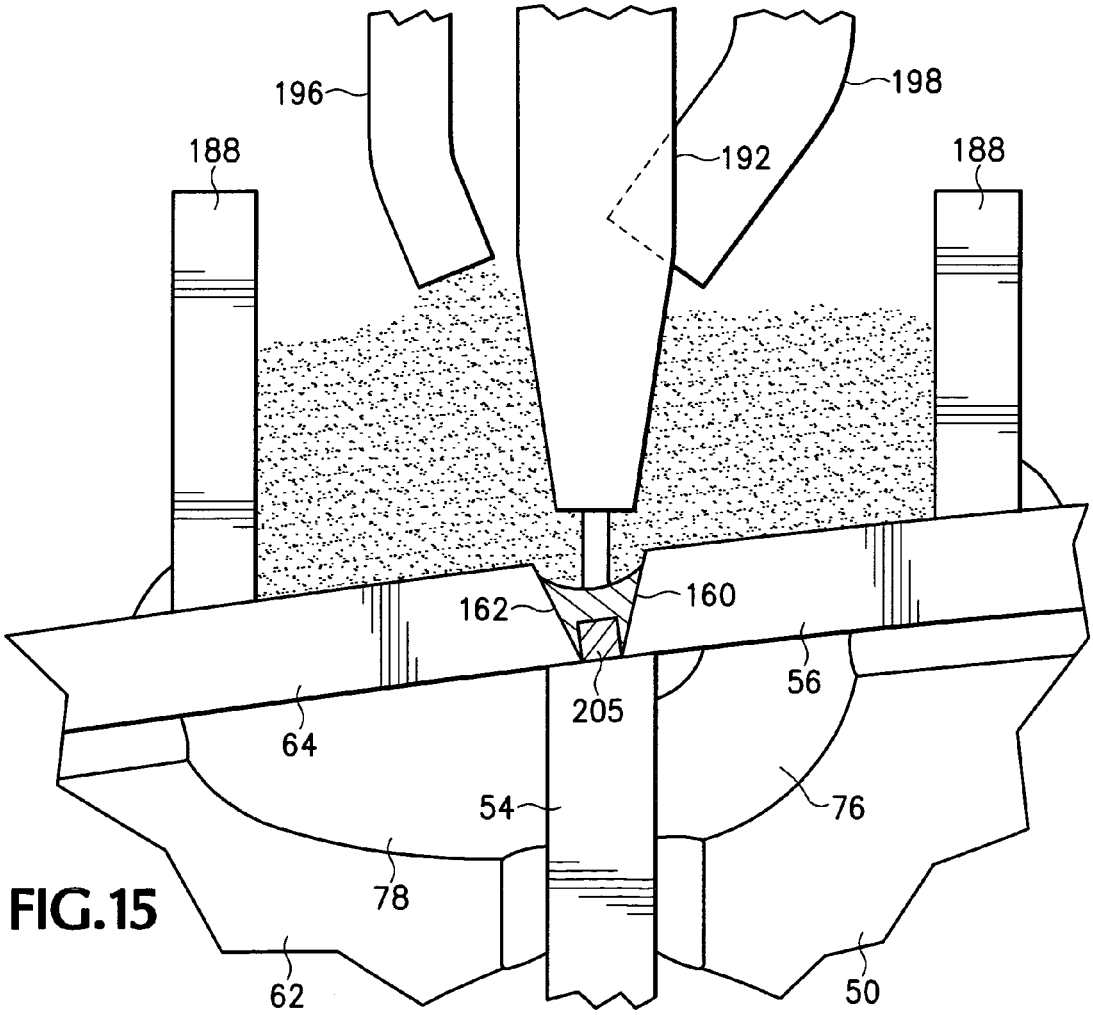
FIG. 15 is a view of a detail of FIG. 14, at an enlarged scale, showing a seam being welded.
Figure 14:
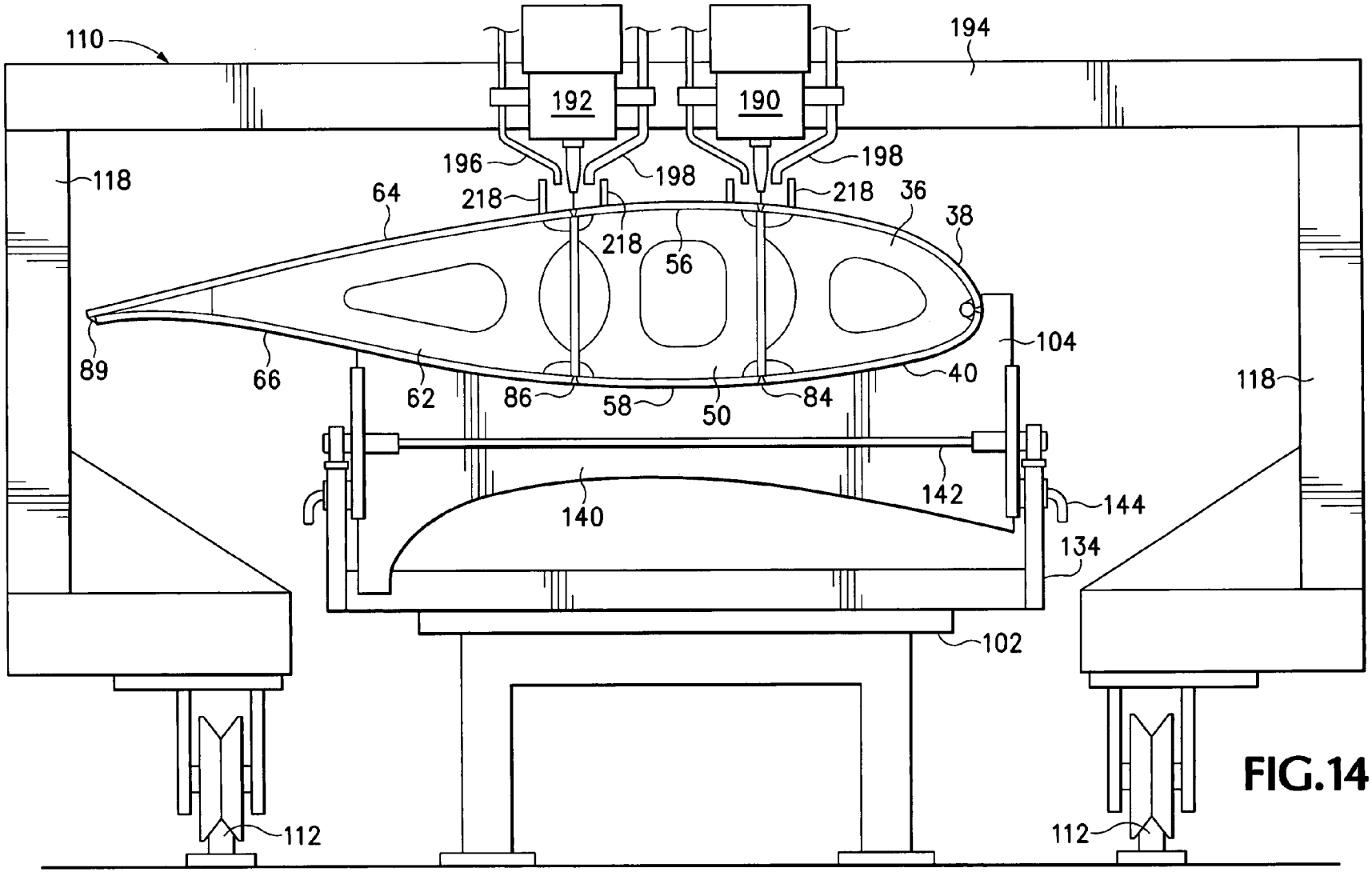
FIG. 14 is an end elevational view of the gantry arrangement and parts assembly table as shown in FIG. 12, showing a pair of seams being welded simultaneously on a hydrofoil structure such as that shown in FIG. 3.

The middle structural section 32 is then placed onto the assembly table 204, aligned with the tail section 34 and is moved into a mating position in which the girder member 54 extends between the margins 162 the top skin section 64 and bottom skin section 66. Short sections 205 of metal such as ¼ inch by ¼ inch square dimensional stock may be tack welded into place along the top and bottom of the girder member 54 to assure that a sufficient root width is provided in the V-shaped grooves between the margins of the top skin parts 56 and 64 and between the margins 160 and 162 of the bottom skin parts 58 and 66. As shown in FIG. 13, the webs 36 of the nose structural section 30 and the webs 62 of the tail structural section 34 may be cut to be slightly larger than the opposite girder member 52 and 54 to assure that after welding of the top skin part 38 and bottom skin part 40 to the nose webs 36, and after welding of the top skin part 56 and bottom skin part 58 to the webs 62 of the tail structural section 34, the margins of the skin parts 38, 40, 56, and 58 will have sufficient separation gaps 210 and 214, despite shrinkage of the web members 36 and 62 because of the welding, so that the margins of the top nose skin part 38 and bottom nose skin part 40 can pass over and fit onto the girder member 52 with a nose skin gap 210 and a girder height 212, and the margins of the top tail skin part 56 and bottom tail skin part 58 can fit similarly over the girder member 54 of the middle structural section 32 as shown in FIG. 13 and a tail skin gap 214 and girder height 216.

Appropriate portable rams may be used to push the two structural sections 32 and 34 toward each other as they are tacked securely together along the joint between the top skin parts 56 and 62 and are also tacked together at the exposed ends of the bottom skin parts 58 and 66. Thereafter the combined middle structural section 32 and tail section 34 are rolled over and the process is repeated to tack weld the bottom skin part 58 and bottom skin part 66 securely together along the entire structure.

Next the nose structural section 30 is placed alongside the combined middle section 32 and tail section 34 and the nose structural section 30 is similarly tacked to the middle structural section 32. The nose structural section 30 may have bowed sufficiently so that initially only the middle part of the length of the nose section 30 will meet the middle structural section 32. This part of the nose structural section 30 may be secured to the middle section 32 with tack welds and thereafter the nose section 30 will have to be forced toward the middle section and tacked at spaced apart locations progressing toward each end of the hydrofoil structure 26.

When the three sections 30, 32, and 34 are securely tacked together the thus preliminarily fastened hydrofoil structure is placed on the table 102 associated with the gantry 110, supported on the stands 134 and the cradle forms 104, that have been aligned with each other atop the table 102. The submerged arc welders 190 and 192 are adjusted to weld the seams 80 and 82 simultaneously to reunite the nose top skin part 38, the middle top skin part 56, and the tail top skin part 64 of the skin 28 of the top of the preliminarily fastened hydrofoil structure as it is shown in FIG. 3, using flux dams 218 temporarily tacked to the skin 28. The submerged arc welders 190 and 192 form weld joints along the V-shaped grooves between the sloped opposed margins 156, 158, or 160, 162 of adjacent skin parts, forming the seams 80 and 82, reuniting the skin 28 and attaching it to the girder members 52 and 54. Using the previously described dual electrode arrangement these welds can be completed in two or three passes of the gantry carrying the welders along the hydrofoil structure 26 at a speed of, for example, 18 inches per minute, thus completing the welds of the seams 80 and 82 in a much shorter time than was previously necessary when they were made manually and required six or seven passes to complete each seam 80 or 82.

Once the seams 80 and 82 are welded completely, the hydrofoil structure 26 is raised and rolled and reversed, and the cradles 140 are raised into position to hold the hydrofoil structure 26 while the seams 84 and 86 on the bottom side are similarly welded simultaneously with two or three passes of the submerged arc welders 190 and 192. Once the seam welds are completed the flux dams 218 are removed and the surfaces of the welded seams 80, 82, 84, and 86, and the surrounding surface where the weld dams 218 had been attached are ground smooth and to a required shape. Finally, excess material from the tail edge 89 which may have been used during the process of assembling the hydrofoil structure as a convenient location for attachment of clamps, etc., used to move and reposition the hydrofoil structure, may be trimmed at 222 by using one of the cutting torches 122, etc. carried by the gantry 110.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A method of preparing a skin plate for a hydrofoil structure, comprising:

(a) cutting a metal plate to an initial size and shape as a skin blank;

(b) determining separation line locations on the skin blank for parallel cuts to separate the skin blank into skin parts for respective structural sections of the hydrofoil structure;

(c) bending the skin blank into a required hydrofoil skin shape;

(d) supporting the skin blank in a predetermined position; and (e) cutting the skin blank into at least two separate skin parts and simultaneously providing a beveled margin on each of those separate skin parts in a single cutting operation by utilizing at least one pair of cutting torches, each cutting torch of each pair cutting a respective bevel on a margin of one of a respective pair of adjacent skin parts while the respective pair of cutting torches are cutting the skin blank along a separation line to separate the same pair of adjacent skin parts from each other.

2. The method of claim 1 wherein the step of cutting the skin blank into the separate skin parts includes cutting the skin blank to provide a nose skin part, a middle skin part, and a tail skin part.

3. The method of claim 1 including cutting respective oppositely beveled margins with opposite respective slopes on the respective skin parts formed on opposite sides of a respective separation line between the skin parts.

4. The method of claim 3 wherein said oppositely beveled margins define a V-shaped groove between adjacent ones of the separate skin parts formed from the skin blank.

5. The method of claim 1 including as a part of the single cutting operation the step of also simultaneously using one of the cutting torches to cut the skin blank so as to form a beveled surface along a nose margin, at an outwardly inclined slope, so that the beveled surface can become a side of a V-shaped groove defined partially by the nose margin of the skin plate.

6. Apparatus for constructing a hydrofoil member of a waterborne vessel, comprising:

(a) a parts support structure;

(b) a gantry having a front end, a rear end, a length, and a width, the gantry being mounted for movement of the gantry longitudinally along a predetermined path with respect to the parts support structure, and including a drive mechanism arranged to move the gantry along the predetermined path;

(c) a plurality of cutting torches spaced apart from one another laterally across the width of said gantry and useable while the gantry is moving along the predetermined path, the plurality of cutting torches including at least one pair, and the ones of the at least one pair of cutting torches being arranged closely behind one another and oriented at an acute angle with respect to each other, so as to cut respective oppositely beveled faces on a pair of margins extending along two opposite sides of a cut through a workpiece supported on the parts support structure; and (d) a plurality of arc welders spaced apart from one another laterally across the width of the gantry, each arc welder being supported on the gantry and all of the plurality being operable simultaneously while the gantry is moving along the predetermined path.

7. The apparatus of claim 6 wherein the drive mechanism is arranged to drive said gantry along the predetermined path at a controlled adjustable rate of speed.

8. The apparatus of claim 6 wherein the parts support structure is adjustable to hold a workpiece in a desired alignment with respect to the gantry.

9. The apparatus of claim 6 wherein the plurality of cutting torches includes at least four said cutting torches arranged in a plurality of pairs, and wherein each pair is arranged to form respective oppositely beveled faces on a pair of margins extending along two opposite sides of a respective cut through a workpiece.

10. The apparatus of claim 6 wherein the cutting torches are gas-burning torches.

11. The apparatus of claim 6 wherein the cutting torches are mounted at the front end of the gantry.

12. The apparatus of claim 6 wherein the arc welders are submerged arc welders.

13. The apparatus of claim 6 wherein the arc welders are mounted at the rear end of the gantry.

14. The apparatus of claim 13 wherein the arc welders are operable while the gantry is moving in a rearward direction.

15. The apparatus of claim 6 wherein the arc welders are arranged with respect to the gantry so as to precede the gantry, while welding, as the gantry moves along the predetermined path with respect to the workpiece.

16. The apparatus of claim 15 wherein the cutting torches are arranged on the front end of the gantry and the arc welders are arranged on the rear end of the gantry.

17. A method of manufacturing a hydrofoil structure, comprising:

(a) providing a first skin plate;

(b) bending the first skin plate to a predetermined skin shape;

(c) cutting the first skin plate into a plurality of skin parts including a hydrofoil nose skin part and a hydrofoil tail skin part, in a single cutting pass along the skin plate, thereby forming a pair of mutually confronting oppositely beveled margins along a cut separating adjacent ones of the resulting plurality of pieces;

(d) assembling a plurality of respective web members and a corresponding opposite side skin part with each of the skin parts to form a plurality of hydrofoil structural sections each including a respective one of the skin parts;

(e) tacking the hydrofoil structural sections to one another as a preliminarily fastened hydrofoil structure; and (f) welding to each other the skin parts cut from the first skin plate, on a first side of the preliminarily fastened hydrofoil structure, by operating a submerged arc welder to weld along a seam joining the oppositely beveled margins of the skin parts on the first side of the preliminarily fastened hydrofoil structure, using a gantry to move said submerged arc welders along the preliminarily fastened hydrofoil structure.

18. A method of manufacturing a hydrofoil structure, comprising:

(a) providing a pair of opposite first and second skin plates;

(b) bending each one of the pair of skin plates to a respective predetermined skin shape;

(c) cutting each one of the pair of skin plates into a plurality of skin parts including a respective hydrofoil nose skin part and a respective hydrofoil tail skin part, in a single cutting pass along each one of the pair of skin plates, thereby forming respective pairs of oppositely beveled confronting margins along cuts separating the plurality of skin parts;

(d) fastening a plurality of nose section webs to the nose skin part of the first one of the pair of skin plates;

(e) thereafter fastening the nose skin part of the second one of the pair of skin plates to the plurality of nose section webs in a position wherein a nose margin of each one of the nose skin parts is aligned with a nose margin of the other one of the nose skin plates;

(f) fastening the respective other skin parts of each one of the pair of skin plates to a respective plurality of web members and corresponding opposite skin parts, thereby forming a plurality of hydrofoil structural sections;

(g) tacking said hydrofoil structural sections to one another, thereby forming a preliminarily fastened hydrofoil structure including a pair of parallel skin joint seams;

(h) supporting the preliminarily fastened hydrofoil structure in a predetermined location with respect to a gantry; and (i) welding the skin parts of a first side of the preliminarily fastened hydrofoil structure to each other by using the gantry to move at least two submerged arc welders to weld simultaneously along at least two parallel seams on the first side of the preliminarily fastened hydrofoil structure.

19. The method of claim 18 including the welding each of the two parallel seams simultaneously at least twice on each of the opposite sides of the preliminarily fastened hydrofoil structure to form respective welded seams each having desired dimensions.

* * * * *